US006276489B1

(12) United States Patent
Busuttil et al.

(10) Patent No.: US 6,276,489 B1
(45) Date of Patent: Aug. 21, 2001

(54) FLANGED CROSS TUBES FOR USE IN SCISSORS LINKAGES

(75) Inventors: John Busuttil, Redmond; Patrick J. Lynch, Kirkland; Michael F. Davis, Seattle, all of WA (US)

(73) Assignee: Genie Industries, Inc., Redmond, WA (US)

( * ) Notice: Subject to any disclaimer, the term of this patent is extended or adjusted under 35 U.S.C. 154(b) by 0 days.

(21) Appl. No.: 09/247,628

(22) Filed: Feb. 10, 1999

(51) Int. Cl.[7] ..... E04G 1/22
(52) U.S. Cl. ..... 182/69.5; 182/69.1
(58) Field of Search ..... 182/69.5, 69.6, 182/63.1, 69.1–69.3, 157, 158, 141

(56) References Cited

U.S. PATENT DOCUMENTS

| | | | | |
|---|---|---|---|---|
| 1,815,236 | * | 7/1931 | Carlson | 182/158 |
| 2,972,392 | | 2/1961 | Kurvers . | |
| 3,157,430 | | 11/1964 | Hamilton . | |
| 3,172,696 | | 3/1965 | De Vos . | |
| 3,279,734 | | 10/1966 | Kramer . | |
| 3,713,495 | | 1/1973 | Redford . | |
| 3,767,236 | | 10/1973 | Horgan, Jr. . | |
| 3,920,096 | | 11/1975 | Fisher . | |
| 4,466,509 | | 8/1984 | Kishi . | |
| 4,741,413 | | 5/1988 | Kishi . | |
| 4,890,692 | | 1/1990 | Oakman . | |
| 4,930,598 | | 6/1990 | Murrill et al. . | |
| 5,099,950 | | 3/1992 | Kishi . | |
| 5,113,972 | | 5/1992 | Haak, Sr. . | |
| 5,139,110 | | 8/1992 | Kishi . | |
| 5,145,029 | * | 9/1992 | Blasdell | 182/69.5 |
| 5,560,582 | | 10/1996 | Beelen . | |

* cited by examiner

*Primary Examiner*—Alvin Chin-Shue
(74) *Attorney, Agent, or Firm*—Perkins Coie LLP

(57) ABSTRACT

A flanged link cross tube (1) for use in pivotal connections of beams (10) that locates weld roots (5) to the outer mating surface of beam (10) and flange (4). As the beams (10) rotate about a pivot connection, high torque loading occurs along the common plane (Z) between adjacent beams (10). Locating weld roots (5) on the outer mating surface of beams (10) and flanges (4) reduces loading on weld roots (5) and extends the useful life of a scissors lift (20).

20 Claims, 4 Drawing Sheets

FLANGED CROSS TUBES FOR USE IN SCISSORS LINKAGES

FIELD OF THE INVENTION

This invention relates to scissors-type lifting devices, and, more particularly, to cross tubes used to receive the pivot pins at the juncture of rectangular cross-section linkages for scissors-type lifts.

BACKGROUND OF THE INVENTION

Aerial work platforms provide access to elevated areas so that workers may easily and safely perform routine maintenance on elevated fixtures, or gain access to elevated construction or storage areas. Generally, a scissors-type aerial work platform consists of a work platform, a scissors lift, and a support base. The scissors lift is extended vertically, usually by a hydraulic actuator mounted on the support base, to raise the work platform to a desired height. The support base may be a mobile structure, such as a small cart or a truck, or a stationary structure.

A scissors lift is a series of pivotally connected scissors-type linkages. Each scissors linkage is formed by pivotally connecting rectangular cross-section elongate beams ("rectangular link tubes") at central axes. Typically, two of the rectangular link tubes are welded together so as to form an "inner link weldment." Another pair of rectangular link tubes are connected together and extend outside the inner link weldment. These two rectangular link tubes form an "outer link weldment." The connected inner and outer link weldments are called a "stack." The outer and inner link weldments are connected at their centers and are rotatable to a first formation in which the two link weldments form an "X," and a second formation in which the two link weldments extend substantially along one another. The stack is connected in series to another stack by pivotally connecting the lower end pair of the outer and inner link weldments to the upper end pair of the outer and inner link weldments of another stack. Additional stacks can be added to form a scissors lift of a desirable size. The uppermost stack is connected to a work platform, with one of the inner and outer link weldments pivotally connected, usually by a hinge, and the other end slidably attached to the work platform. The lowermost stack is similarly connected to the support base.

Typically, at each pivotal connection of the link weldments, each rectangular link tube has a cross tube welded into a hole within the link tube, the cross tube positioned perpendicular to the beam's longitudinal axis. The rectangular link tubes of the inner link weldment are rigidly connected by a central link cross tube. Shorter cross tubes extend through holes in the rectangular link tubes of the outer link weldment. A pivot pin extends through the cross tubes.

Applying a force to one beam of a scissors linkage causes the inner and outer link weldments to rotate relative to one another about their central axes. This rotation displaces the ends of the inner and outer link weldments, which are pivotally connected to the inner and outer link weldments in another stack. The inner and outer link weldments of the adjacent stack also rotate relative to one another. Thus, applying a force to at least one stack in the scissors lift transfers the force to the entire scissors lift structure. As a result, each stack extends or retracts, which in turn elevates or lowers the work platform.

A common problem in scissors-type lifting devices is that the adjoining rectangular link tubes of the inner and outer link weldments undergo opposite moments of torque as they rotate about the pivot connections. This loading fatigues the weld joints between the cross tubes and the rectangular link tubes. Fatigue is most severe at the inside weld joints on the facing surfaces of the rectangular link tubes. At this location, a weld root is formed between the outer surface of the cross tubes and the inner surface of the cross tube hole in the rectangular link tubes. Repetitive loading eventually results in fatigue fractures along these weld roots after 20,000–30,000 operational cycles. As the fractures significantly degrade the structural integrity of the scissors lift, extensive repairs or replacement of parts must be accomplished before the scissors lift can be safely used again.

As will be readily appreciated from the foregoing discussion, there is a need for a cross tube section that reduces the transfer of the torque loading force to the weld joints between the cross tube section and the rectangular link tube, which in turn reduces metal fatigue and thus increases the useful life of the scissors lift apparatus. The present invention is directed to fulfilling this need.

SUMMARY OF THE INVENTION

The present invention provides a link connection having a first hollow beam and a second hollow beam. A first cross tube extends through the first hollow beam and has a first radially-extending annular flange at one end connected to a side of the first hollow beam. A second cross tube extends through the second hollow beam. A pivot pin extends through the first cross tube and the second cross tube so that the first radially-extending annular flange is located between the first and second hollow beams.

In accordance with one aspect of the invention, the first cross tube includes a raised inner bearing surface for mounting a bearing.

In accordance with another aspect of the invention, the first radially-extending annular flange is welded to the side of the first hollow beam.

In accordance with still another aspect of the invention, the second cross tube includes a second radially-extending annular flange at one end connected to a side of the second hollow beam and arranged such that the second radially-extending annular flange is located between the first and second hollow beams.

In accordance with still another aspect of the invention, the first cross tube includes a link section and a flange section, the flange section including the first radially-extending annular flange, and the flange section and the link section being connected together so as to form the cross tube.

The present invention further provides a scissors linkage assembly having two stacks of linkages. The scissors linkage assembly includes first and second hollow beams in the first stack of linkages and third and fourth hollow beams in the second stack of linkages. A first cross tube extends through the first hollow beam. The first cross tube preferably includes a first radially-extending annular flange at one end connected to a side of the first hollow beam.

A second cross tube extends through the second hollow beam and the third hollow beam. Preferably, the second cross tube includes a second radially-extending annular flange at one end connected to a side of the second hollow beam and arranged such that the second radially-extending annular flange is located between the first and second hollow beams; and a third radially-extending annular flange at the opposite end connected to a side of the third hollow beam and arranged such that the third radiallyextending annular flange is located between the third and fourth hollow beams.

A third cross tube extends through the fourth hollow beam; and preferably includes a fourth radially-extending annular flange at one end connected to a side of the fourth hollow beam and arranged such that the fourth radially-extending annular flange is located between the third and fourth hollow beams. A pivot pin extends through the first cross tube, the second cross tube, and the third cross tube.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
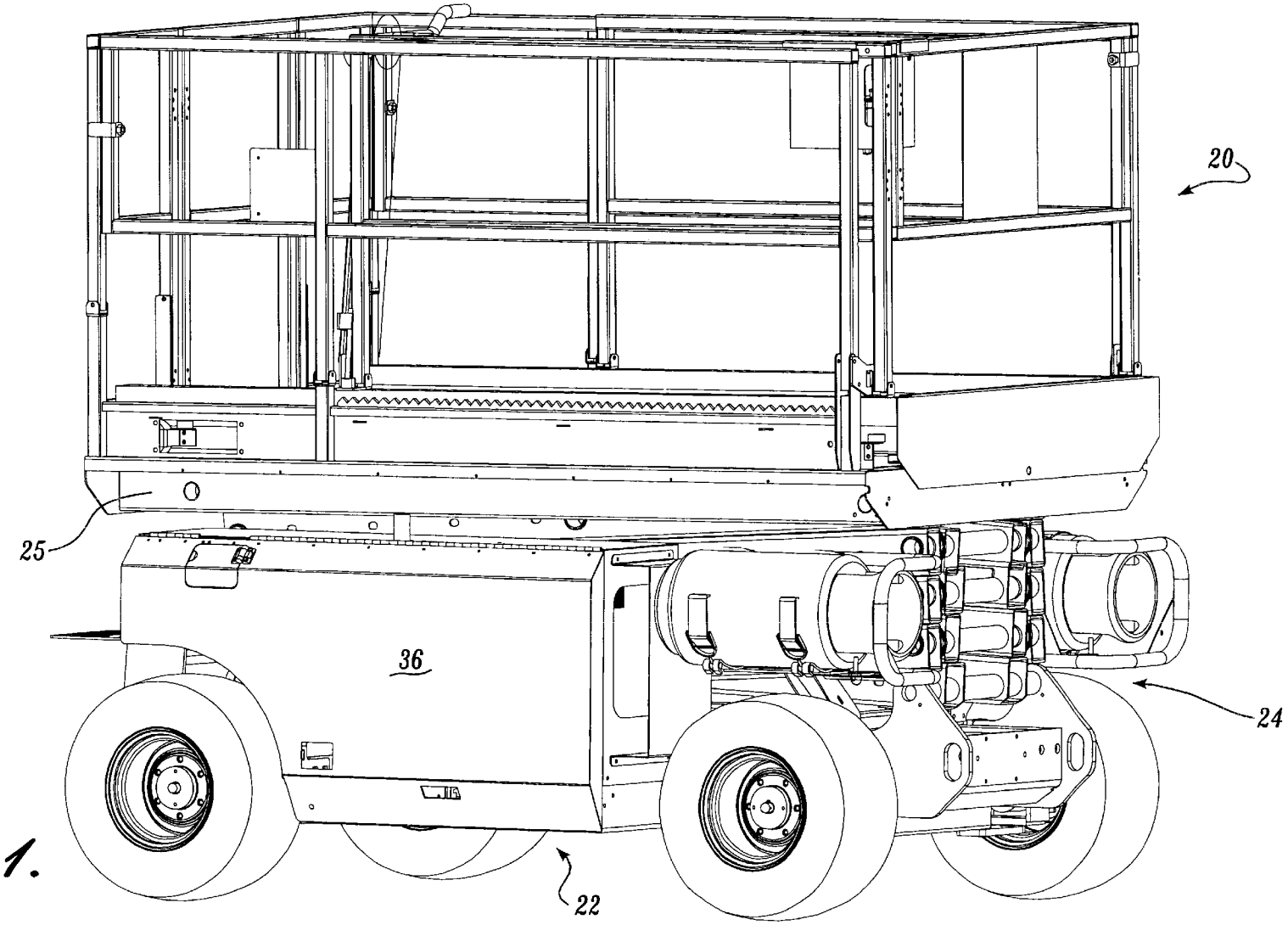
FIG. 1 is a side perspective view of a scissors-type personnel lift having a scissors linkage assembly that incorporates flanged cross-tubes formed in accordance with the present invention.

Referring now to the drawing, in which like reference numerals represent like parts throughout the several views, FIG. 1 shows a scissors lift 20 incorporating the present invention. The scissors lift 20 includes a base 22 connected by a scissors linkage assembly 24 to a work platform 25. During use, the scissors linkage assembly 24 is extended so as to raise the work platform 25.

Figure 2:
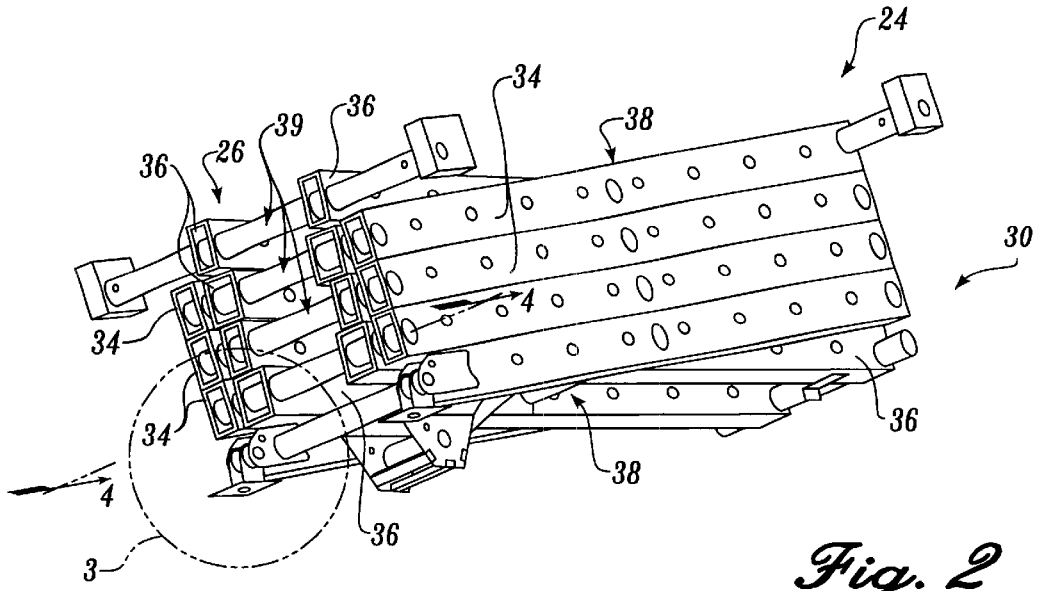
FIG. 2 is a perspective view of the scissors linkage assembly of the scissors-type personnel lift in FIG. 1.
Figure 4:
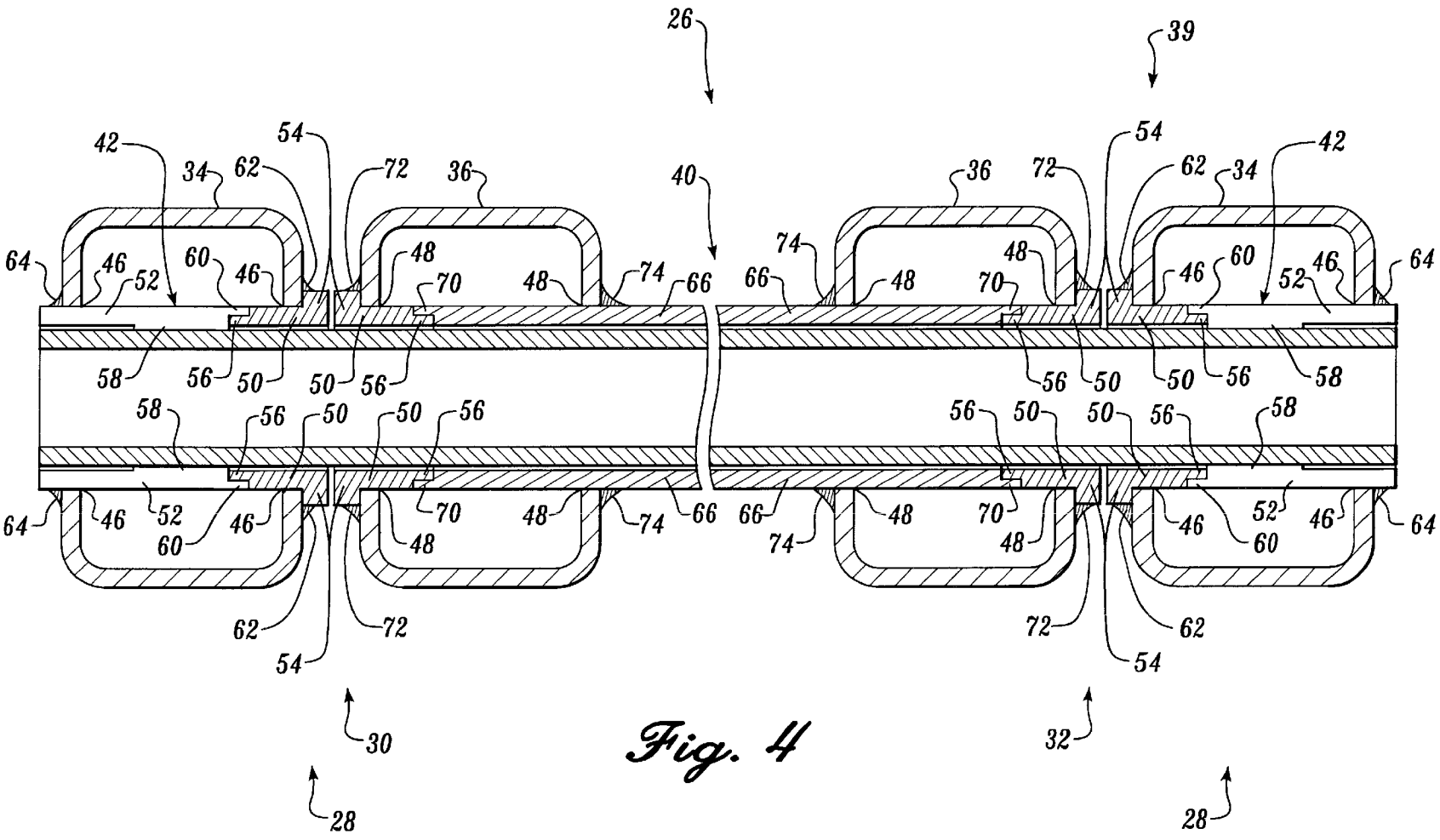
FIG. 4 is a sectional view taken along the section lines 4—4 of FIG. 2, showing an adjacent pair of flanged cross-tubes formed in accordance with this invention.
Figure 5:
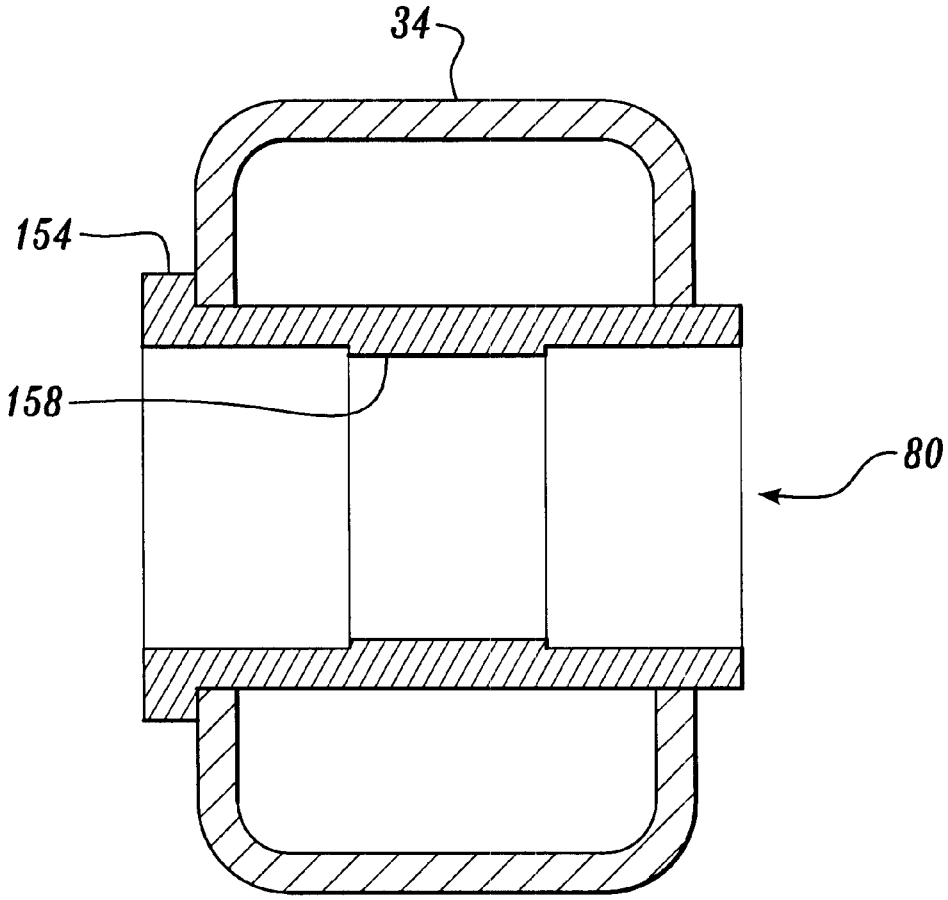
FIG. 5 is a cross-sectional view of an alternate embodiment of a flanged link cross-tube formed in accordance with this invention, wherein the cross tube is formed as a single piece.

FIG. 2 shows the scissors linkage assembly 24. The scissors linkage assembly 24 is formed from inner link weldments 26 pivotally attached to and nested inside of outer link weldments 28. The outer link weldments 28 are formed from a pair of outer rectangular link tubes 34. Each of the inner link weldment 26 is constructed from a pair of inner rectangular link tubes 36. The outer and inner rectangular link tubes 34, 36 are hollow and rectangular in cross-section (FIG. 4). The inner and outer link weldments 26, 28 are rotatably connected at their centers so that they can be configured from a position in which the two weldments form an "X," to a position where the two beams are substantially parallel. The connected inner and outer link weldments 26, 28 form a stack 30 (only one indicated in FIG. 2, but four stacks shown).

A series of the stacks 30 are connected together by pivotally connecting the lower end pair of the inner and outer link weldments 26, 28 of a stack 30 to the upper end pair of the inner and outer link weldments 26, 28 of another stack. The connected series of stacks 30 forms linkage assembly 24.

Adjacent stacks 30 share end pivot points and are connected at those end pivot points by end link sections 39. Inner and outer link weldments 26, 28 are pivotably connected by similar central link sections 38 to form each stack 30. The present invention is directed to unique cross tubes 40, 42 (FIG. 4) for use in the central and end link sections 38, 39. Because the construction of the end link sections 39 and central link sections 38 are similar, only one end link section 39 will be described in detail.

Figure 3:
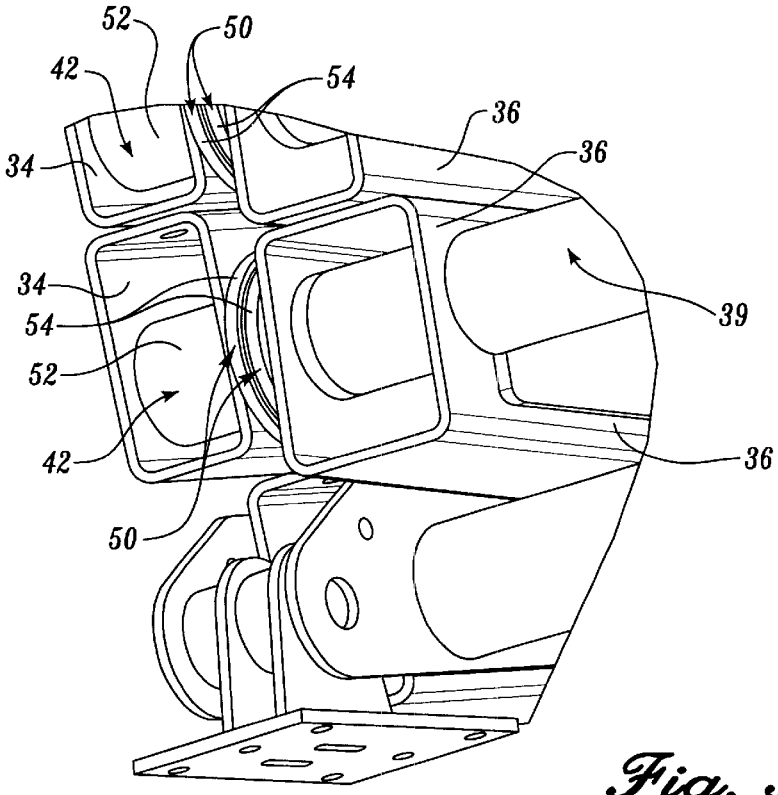
FIG. 3 is a detail view of one end of the scissors linkage assembly of FIG. 2.

FIG. 3 illustrates one end of an end link section 39 formed in accordance with the present invention. As shown in FIG. 4, the end linkage 39 extends from one outer rectangular link tube 34 of the outer link weldment 28, through both inner rectangular link tube 36 of an adjacent stack 30, and on through the adjacent other outer rectangular link tube 34 of the outer link weldment 28. The end link section 39 includes outer cross tubes 42 that extend through each of the outer rectangular link tubes 34. The central cross tube 40 extends through and rigidly links the inner rectangular link tube 36 of the inner link weldment 26.

As can be seen in FIG. 4, the outer and inner rectangular link tubes 34, 36 are each substantially of rectangular cross-section. The outer rectangular link tubes 34 include holes 46 for receiving the outer cross tubes 42. Likewise, the inner rectangular link tubes 36 include holes 48 for receiving the central cross tubes 40. The central cross tube 40 extends through and is connected to both of the inner rectangular link tube 36 of the inner link weldment 26 (best shown in FIG. 4).

Referring again to FIG. 4, the outer cross tube 42 includes two separate pieces: a flanged section 50 and a link section 52. The flanged section 50 is cylindrical in shape and has a uniform internal diameter. An inner end of the flanged section 50 includes an annular flange 54 that extends radially outward and is formed integral with the end of the flanged section 50. The distal end of the flanged section 50 includes a male coupling 56. The male coupling tapers inward from the outer diameter of the flanged section 50.

The link section 52 is cylindrically shaped with a uniform outer diameter. The outer portion of the link section 52 includes a uniform inner diameter. Spaced inwardly from the outer portion of the link section 52 and located inside the cylinder of the link section is a raised bearing mounting surface 58 having a uniform, shorter diameter than the remainder of the link section. A female coupling 60 is formed on the distal end of the link section 52. The female coupling 60 includes an outer diameter that substantially matches the diameter of the remainder of the link section 52. However, the inner diameter is slightly larger than the remainder of the link section, and is tapered to match and fit over the male coupling 56 of the flanged section 50.

In practice, the flanged section 50 is attached to the link section 52, either by placing the two pieces together, or by welding or attaching the two pieces in some suitable manner. The two sections 50, 52 are then inserted through the holes 46 in the outer rectangular link tube 34 until the distal end of the link section 52 extends slightly out of the outer side of the outer rectangular link tube 34, and the annular flange 54 of the flanged section 50 abuts against the inner side of the outer rectangular link tube. The flanged section 50 is then welded to the inner side of the outer rectangular link tube 34 so as to form a weld root 62 between the inner edge of the outer rectangular link tube 34 and the annular flange 54. The outer side of the outer rectangular link tube 34 is then welded to the link section 52 at the juncture of the hole and the link section 52 so as to form a weld root 64.

In the end link section 39, the central cross tube 40 is used to link two inner rectangular link tubes 36, as is shown in FIGS. 2 and 4. As shown in FIG. 4, the central cross tube 40 includes two flanged sections 50 that are identical to the flanged section 50 described with reference to the outer cross tube 42 above. In addition, the central cross tube 40 includes an elongate link section 66, each end of which is shaped like the link section 52 for the outer cross tube 42, except the elongate link section 66 does not include raised bearing mounting surfaces at each end. However, the elongate link section 66 includes female couplings 70 (similar to female coupling 60) at each end.

In practice, one of the flanged sections 50 is welded, otherwise connected, or just placed on one of the female couplings 70 of the elongate link section 66, and the combined elongate link section and flanged section are inserted through the holes 48 on one of the inner rectangular link tubes 36. The annular flange 52 is aligned against the outer surface of the inner rectangular link tube 36 and is welded in place so as to form a weld root 72 similar to the weld root 62. A second weld root 74 is formed at the juncture of the hole 48 at the inner side of the inner rectangular link tube 36 and the elongate link section 66.

The opposite flanged section 50 is welded in place against the outer surface of the opposite inner rectangular link tube 36 so that flange is connected by a weld root 72 to the inner rectangular link tube, and the male coupling 56 extends inside the inner rectangular link tube. The unwelded end of the elongate link section 66 is then inserted through the hole 48 on the inner side of the inner rectangular link tube 36 and the female coupling 70 is fitted over the male coupling 56 of the flanged section 50. The elongate link section 66 is then welded to the inner side of the inner rectangular link tube 36 at the junction of the hole 48 and the elongate link section 66 so as to form a second weld root 74.

After the outer cross tubes 42 have been mounted in the outer rectangular link tubes 34 and the central cross tube 40 has been mounted through adjacent inner rectangular link tubes 36, a pivot pin 76 is extended through the pair of outer cross tubes and the central cross tube 40 so as to create a pivot for the adjacent stacks 30. Similar outer cross tubes 42 and central cross tubes 40 are used at each of the end link sections 39 and central link sections 38. Pivot pins 76 also extend into each one of these link sections. If desired, internal plastic bearings (not shown, but well known in the art) can be mounted within the flanged sections 50 that abut against the raised bearing mounting surfaces 58 and receive the pivot pin so as to reduce rotational friction.

The central and outer cross tubes 40, 42 provide the advantage of moving the weld roots 62, 72 away from the joints formed by the interface of the cross tubes 40, 42 and the holes 46, 48. During operation, adjoining inner and outer rectangular link tubes 34, 36 undergo opposite moments of torque as they rotate about the pivot connection of the end link sections 39 or central link sections 38. The load is most severe on the inside weld joints (that is, the weld joints at the inner portions of the outer rectangular link tubes 34 and the outer portion of the inner rectangular link tubes 36). The annular flanges 54 rest against these surfaces of the inner and outer rectangular link tubes 36, 34, thereby removing the weld roots away from the joints formed by the interface of the cross tubes 40, 42 and the inner surface of the holes 46. Moving the flange weld roots 62, 72 to the outer surfaces of the inner and outer rectangular link tubes 34, 36 reduces the load on the weld roots, thus making the weld roots less susceptible to fatigue and cracking.

Although the outer cross tubes 42 are shown as made of two separate pieces, an outer cross tube 80 can also be constructed of a single piece, having a flange 154 and a raised bearing mounting surface 158 as is shown in FIG. 6. The outer cross tube 80 constructed in this manner can be used as an outer cross tube in the outer rectangular link tube 34. Additionally, the central cross tube 40 could be formed by providing an integral flanged section with the elongate link section, and then adjoining a separate flanged section 52 with the integral piece. However, using the flanged sections 50 and the link sections 52, 66 described allows the flanged sections 50 to be standardized, thus providing a less expensive manner of manufacturing the central and outer cross tubes 40, 42.

While the preferred embodiment of the invention has been illustrated and described with reference to preferred embodiments thereof, it will be appreciated that various changes can be made therein without departing from the spirit and scope of the invention as defined in the appended claims.

The embodiments of the invention in which an exclusive property or privilege is claimed are defined as follows:

1. A linkage assembly, comprising:

a first tube;

a second tube;

a first cross tube extending through the first tube and having a first radially-extending annular flange at one end connected to a side of the first tube;

a second cross tube extending through the second tube; and a pivot pin extending through the first cross tube and the second cross tube, the first radially-extending annular flange being located between the first and second tubes.

2. The linkage assembly of claim 1, wherein the first cross tube comprises a raised inner bearing surface for mounting a bearing.

3. The linkage assembly of claim 1, wherein the first radially-extending annular flange is welded to the side of the first tube.

4. The linkage assembly of claim 1, wherein the second cross tube further comprises a second radially-extending annular flange at one end connected to a side of the second tube and arranged such that the second radially-extending annular flange is located between the first and second tubes.

5. The linkage assembly of claim 4, wherein the second radially-extending annular flange is welded to the side of the second tube.

6. The linkage assembly of claim 2, wherein the second cross tube further comprises a second radially-extending annular flange at one end connected to a side of the second tube and arranged such that the second radially-extending annular flange is located between the first and second tubes.

7. The linkage assembly of claim 1, wherein the first cross tube comprises a link section and a flange section, the flange section including the first radially-extending annular flange, the flange section and the link section being connected together so as to form the first cross tube.

8. A scissors linkage assembly comprising a stack of linkages, the scissors linkage assembly comprising:

a first tube in said stack of linkages;

a second tube in said stack of linkages;

a third tube in said stack of linkages;

a fourth tube in second stack of linkages;

a first cross tube extending through the first tube and having a first radially-extending annular flange at one end connected to a side of the first tube;

a second cross tube extending through the second tube and the third tube;

a third cross tube extending through the fourth tube; and a pivot pin extending through the first cross tube, the second cross tube, and the third cross tube, the first radially-extending annular flange being located between the first and second tubes.

9. The linkage assembly of claim 8, wherein the first cross tube comprises a raised inner bearing surface for mounting a bearing.

10. The linkage assembly of claim 8, wherein the first radially-extending annular flange is welded to the side of the first tube.

11. The linkage assembly of claim 8, wherein the second cross tube further comprises a second radially-extending annular flange at one end connected to a side of the second tube and arranged such that the second radially-extending annular flange is located between the first and second tubes.

12. The linkage assembly of claim 11, wherein the second radially-extending annular flange is welded to the side of the second tube.

13. The linkage assembly of claim 11, wherein the second cross tube further comprises a third radially-extending annular flange at the opposite end connected to a side of the third tube and arranged such that the third radially-extending annular flange is located between the third and fourth tubes.

14. The linkage assembly of claim 13, wherein the third radially-extending annular flange is welded to the side of the third tube.

15. The linkage assembly of claim 13, wherein the third cross tube further comprises a fourth radially-extending annular flange at one end connected to a side of the fourth tube and arranged such that the fourth radially-extending annular flange is located between the third and fourth tubes.

16. The linkage assembly of claim 15, wherein the fourth radially-extending annular flange is welded to the side of the fourth tube.

17. A scissors linkage assembly comprising two a stack of linkages, the scissors linkage assembly comprising:

a first tube in said stack of linkages;

a second tube in said stack of linkages;

a third tube in said stack of linkages;

a fourth tube in said stack of linkages;

a first cross tube extending through the first tube;

a second cross tube extending through the second tube and the third tube and having a first radially-extending annular flange at one end connected to a side of the second tube and second radially-extending annular flange at another end connected to a side of the third tube;

a third cross tube extending through the fourth tube; and a pivot pin extending through the first cross tube, the second cross tube, and the third cross tube, the first radially-extending annular flange being located between the first and second tubes and the second radially-extending annular flange being located between the third and fourth tubes.

18. The linkage assembly of claim 17, wherein the first cross tube further comprises a third radially-extending annular flange at one end connected to a side of the first tube and arranged such that the third radially-extending annular flange is located between the first and second tubes.

19. The linkage assembly of claim 18, wherein the third cross tube further comprises a fourth radially-extending annular flange at one end connected to a side of the fourth tube and arranged such that the fourth radially-extending annular flange is located between the third and fourth tubes.

20. The linkage assembly of claim 17, wherein the first cross tube comprises a link section and a flange section, the flange section including the first radially-extending annular flange, the flange section and the link section being connected together so as to form the first cross tube.

* * * * *